US011326380B2

(12) United States Patent
Zhao

(10) Patent No.: US 11,326,380 B2
(45) Date of Patent: May 10, 2022

(54) ANTI-COLLISION SYSTEM AND ANTI-COLLISION METHOD FOR ANTI-COLLISION DOOR

(71) Applicant: SHANGHAI IMILAB TECHNOLOGY CO., LTD., Shanghai (CN)

(72) Inventor: Jian Zhao, Shanghai (CN)

(73) Assignee: SHANGHAI IMILAB TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/371,071

(22) Filed: Jul. 8, 2021

(65) Prior Publication Data

US 2022/0112757 A1 Apr. 14, 2022

(30) Foreign Application Priority Data

Oct. 13, 2020 (CN) ..... 202011088105.9
Oct. 13, 2020 (CN) ..... 202011088217.4

(51) Int. Cl.
*E05F 5/02* (2006.01)
*E05C 17/00* (2006.01)
*E05C 17/56* (2006.01)

(52) U.S. Cl.
CPC ..... *E05F 5/02* (2013.01); *E05C 17/00* (2013.01); *E05C 17/56* (2013.01); *E05Y 2201/246* (2013.01); *E05Y 2201/462* (2013.01); *E05Y 2400/20* (2013.01); *E05Y 2400/44* (2013.01); *E05Y 2400/45* (2013.01); *E05Y 2900/132* (2013.01); *Y10T 292/11* (2015.04)

(58) Field of Classification Search
CPC ..... E05Y 2900/132; E05Y 2400/20; E05Y 2400/44; E05Y 2400/45; E05F 5/027; E05F 5/02; E05C 17/56; E05C 17/00; E05C 19/16; Y10T 292/11; G08B 13/08
USPC ..... 340/545.1
See application file for complete search history.

(56) References Cited

U.S. PATENT DOCUMENTS 3,829,138 A * 8/1974 Morita ..... E05B 63/248 292/254
3,895,281 A * 7/1975 Corbaz ..... H01F 7/1653 318/687
4,952,080 A * 8/1990 Boiucaner ..... G05B 19/232 318/602

(Continued)

*Primary Examiner* — Christine M Mills
*Assistant Examiner* — Faria F Ahmad
(74) *Attorney, Agent, or Firm* — Fideli Law PLLC

(57) ABSTRACT

An anti-collision system and an anti-collision method are disclosed. The anti-collision system includes a first circuit and a magnetic device arranged on the door body and the door frame respectively, the first circuit includes a first power source, a first coil, and a first switch circuit connecting the first power source and the first coil; when a speed sensor detects that the rotation speed of the door body is too high, a control terminal controls the first switch circuit to switch on, such that the first coil is connected to the first power source to generate a first magnetic field, which causes a repulsive force to reduce the rotation speed of the door; when the rotation speed of the door body is reduced to a preset value, the control terminal controls the first switch circuit to switch off, the repulsive force disappears, and the door body is closed smoothly.

20 Claims, 9 Drawing Sheets

(56) References Cited

U.S. PATENT DOCUMENTS 5,243,735 A * 9/1993 O'Brien, II ..... E05F 1/105 16/64
5,396,158 A * 3/1995 Long ..... H02H 7/0851 318/266
5,801,340 A * 9/1998 Peter ..... G01S 13/04 178/20.04
5,913,763 A * 6/1999 Beran ..... E05F 15/70 49/506
6,175,204 B1 * 1/2001 Calamatas ..... H02P 7/04 318/375
6,370,732 B1 * 4/2002 Yezersky ..... E05C 17/203 16/82
6,401,392 B1 * 6/2002 Yuge ..... E05F 15/619 49/340
6,955,389 B2 * 10/2005 Suzuki ..... E05B 65/0811 292/201
7,688,179 B2 * 3/2010 Kurpinski ..... G07C 9/00309 340/5.72
8,449,001 B2 * 5/2013 Whitens ..... E05C 19/16 292/251.5
9,834,974 B2 * 12/2017 Elie ..... E05F 15/70
2002/0039008 A1 * 4/2002 Edgar ..... H02H 7/0851 318/445
2002/0189168 A1 * 12/2002 Sicuranza ..... E05C 17/00 49/26
2005/0280284 A1 * 12/2005 McLain ..... B60R 13/043 296/146.1
2007/0186480 A1 * 8/2007 Freeman ..... E05F 15/624 49/358
2008/0030045 A1 * 2/2008 Lai ..... E05C 17/00 296/146.1
2010/0076651 A1 * 3/2010 Nakakura ..... G01S 7/4811 701/49
2011/0203181 A1 * 8/2011 Magner ..... E05B 83/01 49/324
2013/0138303 A1 * 5/2013 McKee ..... E05F 15/73 701/49
2014/0001779 A1 * 1/2014 Bedoian ..... E05B 17/22 292/336.3
2014/0173985 A1 * 6/2014 Alsadah ..... E05F 15/40 49/30
2014/0373454 A1 * 12/2014 Sasaki ..... E05F 15/63 49/350
2017/0030126 A1 * 2/2017 Elie ..... E05F 15/00
2017/0058577 A1 * 3/2017 Ben Abdelaziz ..... E05B 77/12
2018/0313128 A1 * 11/2018 Hucker ..... E05F 15/603
2019/0112858 A1 * 4/2019 Partsch ..... E05F 5/025

* cited by examiner

ANTI-COLLISION SYSTEM AND ANTI-COLLISION METHOD FOR ANTI-COLLISION DOOR

RELATED APPLICATIONS

This application claims priority to Chinese Application number 202011088105.9, filed on Oct. 13, 2020, and Chinese Application number 202011088217.4, filed on Oct. 13, 2020, which are incorporated herein by reference.

TECHNICAL FIELD

The disclosure relates to the field of intelligent furniture, in particular to an anti-collision system and an anti-collision method for an anti-collision door.

BACKGROUND

A conventional door may be easily slammed by people or a wind, which may affect the service life of the door. At present, the traditional solution is that magnets which attract each other are arranged on a wall surface and a door respectively, such that when the door is opened, the door is attracted to the wall through the magnetic force of the magnets, thereby preventing to door from being "slammed". However, there are some problems in this solution. For example, when the magnetic force of the magnets is too small, the door may still be slammed by a strong wind; or when the magnetic force is too large, the door may be difficult to close. In addition, in this solution, only when the door is opened to the maximum position may the door be attracted to the magnet on the wall, while when the door is in other positions, the magnetic force does not work. In addition, the magnetic force may cause impacts between the magnet on the door and that on the wall, which affect the surface life of the door. Furthermore, this solution cannot prevent a door to be slammed by a person intentionally.

Therefore, there is a need for an anti-collision system and an anti-collision method for an anti-collision door.

SUMMARY

The technical problem to be resolved is as follows:

In view of the above-mentioned shortcomings, the technical problem to be solved by one or more embodiments of this disclosure is to prevent a collision between the door body and the door frame without affecting the door closing.

According to a first aspect of the present disclosure, an anti-collision system of an anti-collision door is provided, a first circuit installed on a door body or a door frame of an anti-collision door, including: a first power source, a first coil connected to the first power source to generate a first magnetic field, and a first switch circuit connected to the first coil and the first power source; a magnetic device arranged on the door body or the door frame where the first circuit is not installed to generate a first repulsive force with the first magnetic field; a speed sensor arranged on the door body to detect a rotation speed of the door body; and a control terminal in communication with the speed sensor and the first switch circuit to control the first switch circuit to switch on or switch off based on the rotation speed of the door body detected by the speed sensor.

According to a second aspect of the present disclosure, an anti-collision method is provided, including: providing an anti-collision system, where the anti-collision system includes: a first circuit installed on a door body or a door frame of an anti-collision door, including: a first power source, a first coil connected to the first power source to generate a first magnetic field, and a first switch circuit connected to the first coil and the first power source, a magnetic device arranged on the door body or the door frame where the first circuit is not installed to generate a first repulsive force with the first magnetic field, a speed sensor arranged on the door body to detect a rotation speed of the door body, and a control terminal in communication with the speed sensor and the first switch circuit; obtaining, by the control terminal, the rotation speed of the door body detected by the speed sensor; and controlling, by the control terminal, the first switch circuit to switch on or switch off based on the rotation speed of the door body.

In summary, the anti-collision system and the anti-collision method provided in this disclosure are respectively provided with a first circuit and a magnetic device on the door body and the door frame, where the first circuit includes a first power source, a first coil and a first switch circuit connecting the first power source and the first coil, and a speed sensor is installed on the door body to detect the rotation speed of the door body, and when the rotation speed of the door body is too high, the control terminal controls the first switch circuit to switch on to enable the first coil to be connected with a first power supply, the first coil generates a first magnetic field under the action of current, and the first magnetic field and the magnetic device generate mutually exclusive force, thereby reducing the rotation speed of the door body and effectively preventing a collision between the door body and the door frame; when the rotation speed of the door body is reduced to a preset value, the control terminal controls the first switch circuit to be switched off to enable the mutual repulsion between the first magnetic field and the magnetic device disappears, and the door body may be closed smoothly. The anti-collision system and the anti-collision method may effectively prevent the collision between the door body and the door frame without affecting the door closing.

Other functions of this disclosure may be partially listed in the following description. According to the description, the contents of the following numbers and examples may be obvious to those of ordinary skill in the art. The inventive aspects of this disclosure may be fully explained by practicing or using the methods, devices and combinations described in the following detailed examples.

BRIEF DESCRIPTION OF THE DRAWINGS

In order to explain the technical solutions in the disclosure, the following will briefly describe the drawings needed in the embodiment description. Obviously, the drawings in the following description are only some exemplary embodiments of the disclosure. For those skilled in the art, other drawings may be obtained according to these drawings without creative efforts.

DETAILED DESCRIPTION

The following description provides the specific disclosure scenarios and requirements of this disclosure in order to enable those skilled in the art to make or use the contents of this disclosure. Various modifications to the disclosed embodiments will be apparent to those skilled in the art, and the general principles defined herein may be applied to some exemplary embodiments without departing from the scope of this disclosure. Therefore, this disclosure is not limited to the illustrated embodiments, but is to be accorded the broadest scope consistent with the claims.

The terminology used herein is for the purpose of describing specific exemplary embodiments only, and is not restrictive. For example, as used herein, the singular forms "a", "an" and "the" may also include the plural forms unless the context clearly indicates otherwise. As used in this disclosure, the terms "including", "comprising" and/or "containing" mean the presence of associated integers, steps, operations, elements and/or components, but do not exclude the presence of one or more other features, integers, steps, operations, elements, components and/or groups or other features, integers, steps may be added to the system/method. As used in this disclosure, the term "A is on B" may mean that A is directly adjacent to B (above or below), and it may also mean that A and B are indirectly adjacent (that is, there are some substances between A and B); the term "A is inside B" may mean that A is all inside B, or part of A is inside B.

In view of the following description, these and other features of the present disclosure, as well as the operation and function of related elements of the structure, and the combination of components and the economy of manufacturing may be significantly improved. With reference to the drawings, all of which form part of this disclosure. However, it should be clearly understood that the drawings are for illustration and description purposes only and are not intended to limit the scope of the disclosure. It should also be understood that the drawings are not drawn to scale.

Figure 1:
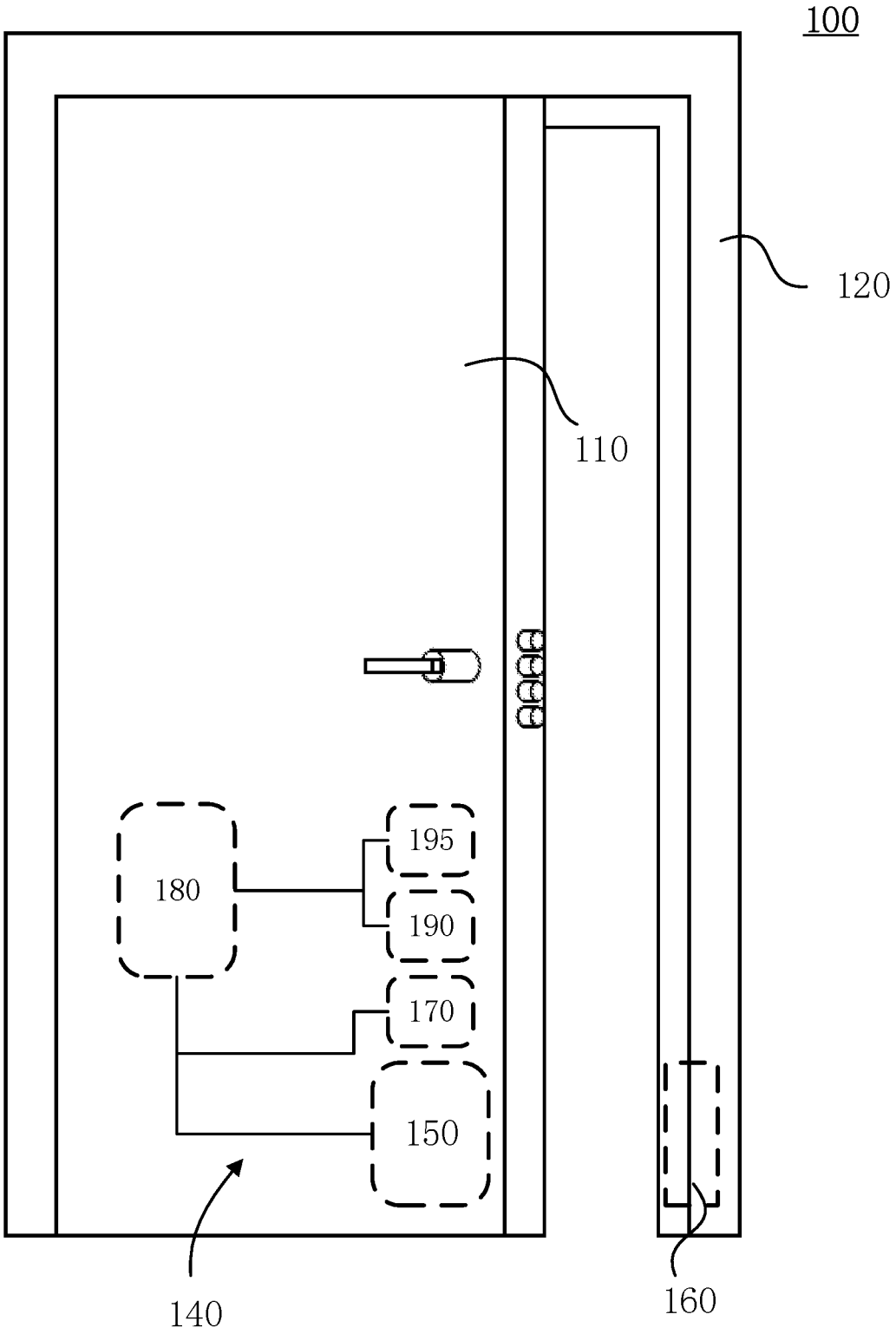
FIG. 1 is a structural schematic diagram of an anti-collision door provided by some exemplary embodiments of this disclosure.

FIG. 1 is a structural schematic diagram of an anti-collision door 100 provided by some exemplary embodiments of this disclosure. The anti-collision door 100 may be a security door of a building, an apartment door in a building, a room door inside an apartment, a door of a security cabinet, or even a door installed on a window. As shown in FIG. 1, the anti-collision door 100 provided in this disclosure may include a door body 110, a door frame 120 and an anti-collision system 140.

The door body 110 may be mounted on the door frame 120 via a hinge, and is rotatably connected to the door frame 120 via the hinge, thereby enabling opening and closing of the door body 110.

Figure 2:
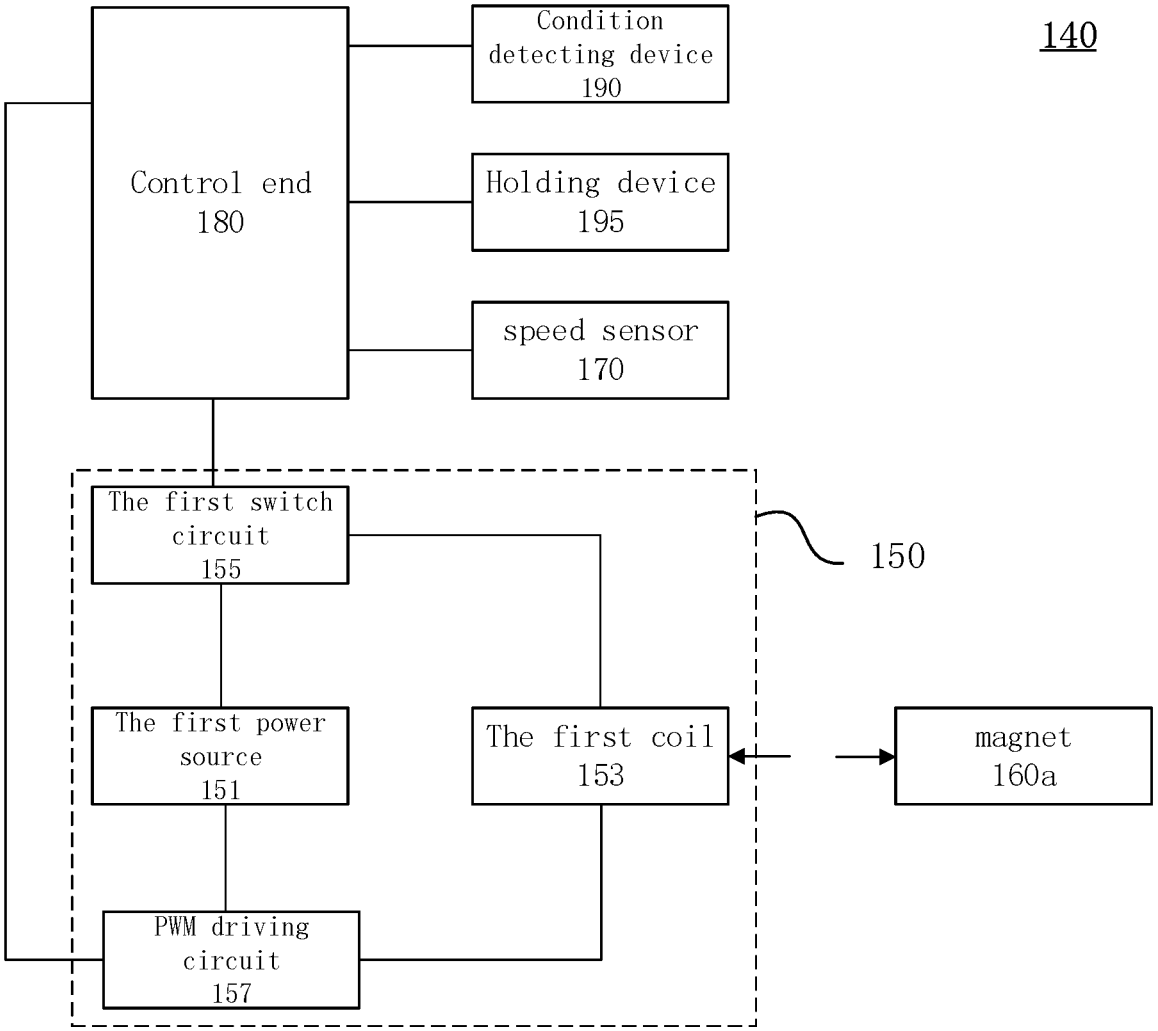
FIG. 2 is a hardware schematic diagram of an anti-collision system provided by some exemplary embodiments of this disclosure.

FIG. 2 is a hardware schematic diagram of an anti-collision system 140 provided by some exemplary embodiments of this disclosure. As shown in FIG. 1 and FIG. 2, the anti-collision system 140 may include a first circuit 150, a magnetic device 160, a speed sensor 170, and a control terminal 180. In some exemplary embodiments, the anti-collision system 140 may further include a state detecting device 190 and a holding device 195. The first circuit 150 and the magnetic device 160 repel each other, resulting in a repulsive force therebetween. In the anti-collision system 140, the first circuit 150 and the magnetic device 160 are installed on the door body 110 and the door frame 120, respectively. The repulsive force between the first circuit 150 and the magnetic device 160 may reduce the relative speed between the door body 110 and the door frame 120, thereby preventing a collision between the door body 110 and the door frame 120. The first circuit 150 and the magnetic device 160 may be installed at a hinged end of the door body 110 and a hinged end of the door frame 120 respectively, alternatively, they may be installed at a rotation end of the door body 110 and a corresponding end of the door frame 120 respectively, or an upper end of the door body 110 and an upper end of the door frame 120, and so on. As shown in FIG. 1, the first circuit 150 is installed at the rotation end of the door body 110, and the magnetic device 160 is installed on the door frame 120 at a position corresponding to the first circuit 150. However, what is shown in FIG. 1 is an exemplary illustration, the first circuit 150 may be installed at any position of the door body 110, and the magnetic device 160 may also be installed at any position of the door frame 120. It should be noted that the first circuit 150 may be installed on the door frame 120, and the magnetic device 160 may be installed on the door body 110, which are also within the scope of protection of this disclosure.

As shown in FIG. 1 and FIG. 2, the speed sensor 170 may be installed on the door body 110 and configured to detect the rotation speed of the door body 110. The speed sensor 170 may include at least one of an acceleration sensor, an angular acceleration sensor, a speed sensor, or an angular speed sensor.

The control terminal 180 may be in communication with the first circuit 150 and the speed sensor 170. In some exemplary embodiments, the control terminal 180 may also be in communication with the magnetic device 160, the state detecting device 190 and the holding device 195. The communication herein refers to any form of communication that may directly or indirectly transmit/receive information, thereby establishing signal transmission. For example, the first circuit 150 and the speed sensor 170 may be directly connected with the control terminal 180 through wires to transmit control signals. The control terminal 180 may control the repulsive force between the first circuit 150 and the magnetic device 160 according to the rotation speed of the door 110 detected by the speed sensor 170. When the speed sensor 170 detects that the rotation speed of the door 110 is greater than a first threshold, the control terminal 180 may control the first circuit 150 to generate a repulsive force between the first circuit 150 and the magnetic device 160 to reduce the rotation speed of the door 110 under the repulsive force. When the speed sensor 170 detects that the rotation speed of the door 110 is less than a second threshold, the control terminal 180 may control the first circuit 150 to reduce or even eliminate the repulsive force between the first circuit 150 and the magnetic device 160, so as to allow the door 110 to be closed smoothly, where the first threshold is greater than the second threshold.

Thus, the control terminal 180 controls the generation and elimination of the repulsive force between the first circuit 150 and the magnetic device 160 based on the rotation speed of the door body 110 obtained from the detection data of the speed sensor 170. The rotation speed of the door body 110 may be reduced to prevent a collision when the door body 110 moves at a relatively high speed. Under the condition that the door moves at a relatively low speed, the repulsive force may be reduced or even eliminated to allow the door body 110 to be closed smoothly, thereby avoiding the situation that the door is difficult to close.

As shown in FIG. 1 and FIG. 2, the first circuit 150 may be installed on the door body 110 or the door frame 120. The first circuit 150 may include a first power source 151, a first coil 153, and a first switch circuit 155.

The first power source 151 may be a municipal AC power source (commercial power for short). The specifications of the municipal AC power supply in different regions may be different, which is not specifically limited herein. For example, the municipal AC power supply may be 220V AC in China or 110V AC in the United States or other regions. The municipal AC power supply may be an ordinary municipal AC outlet. The first power source 151 may also be a battery. The battery may be a secondary battery, such as a lithium battery, a nickel-hydrogen battery, a lead-acid battery, etc., or a primary battery, etc. The capacity of the battery may be 20000 mAH, larger, or smaller, such as 30000 mAH or 10000 mAH, or even 4000 mAH, and so on.

The first coil 153 may be an inductance coil connected to the first power source 151. When the first coil 153 is connected to the first power source 151, the first coil 153 may generate a first magnetic field under the current.

The first switch circuit 155 may connect the first coil 153 and the first power source 151. The control terminal 180 may be in communication with the first switch circuit 155, and controls the first switch circuit 155 to switch on or switch off based on the rotation speed of the door body 110 detected by the speed sensor 170. When the rotation speed of the door 110 is greater than the first threshold, the control terminal 180 may control the first switch circuit 155 to switch on, the first coil 153 is connected to the first power source 151, and a current may pass through the first coil 153. The first coil 153 generates the first magnetic field under the current, and a repulsive force may be generated between the first magnetic field and the magnetic device 160, which reduces the rotation speed of the door 110, thereby preventing collisions. When the rotation speed of the door 110 is lower than the second threshold, the control terminal 180 may control the first switch circuit 155 to switch off, the first coil 153 and the first power source 151 are disconnected, no current passes through the first coil 153, so the first coil 153 does not generate the first magnetic field, and the repulsive force between the first coil 153 and the magnetic device 160 disappears, which allows the door 110 to be closed smoothly.

The first switch circuit 155 may include at least one of a programmable switch circuit, a triode switch circuit, or a diode switch circuit. For example, the first switch circuit 155 may be the programmable relay switch, which is connected to the control terminal 180, and the control terminal 180 may control the ON or OFF of the programmable relay switch by controlling the voltage of the programmable relay switch. For example, the first switch circuit 155 may be the triode switch circuit, and the control terminal 180 may control the triode switch circuit to switch on or switch off by controlling the voltage input to the triode switch circuit. For example, the first switch circuit 155 may be the diode switch circuit, and the control terminal 180 may control the diode switch circuit in the same way as the triode switch circuit, which will not be described herein again. It should be noted that the first switch circuit 155 may also be any other switch circuit, and any switch circuit that may turn on or turn off the first switch circuit 155 through the control terminal 180 is within the scope of this disclosure.

The control terminal 180 may control the first switch circuit 155 to control the first magnetic field, therefore the speed of the door body 110 may be reduced to prevent a collision when the door moves at a relatively high speed, and the first circuit 150 may be turned off when the door body 110 moves at a relatively low speed, therefore the door body 110 may be closed smoothly to prevent the collision.

In some exemplary embodiments, the anti-collision system 140 may further include a PWM (Pulse-Width Modulating) driving circuit 157. As shown in FIG. 2, the PWM driving circuit 157 may be connected to the first power source 151 and the first coil 153. The PWM driving circuit 157 may be in communication with the control terminal 180. The control terminal 180 may control the duty cycle of the PWM signal (i.e., the percentage of the ratio of pulse duration, or pulse width (PW) to the total period (T) of the waveform.) in the PWM driving circuit 157, so as to control the voltage of the first coil 153 and control the magnitude of the repulsive force. Specifically, the control terminal 180 may control the duty cycle of the PWM signal based on a preset relationship between the rotation speed of the door 110 and the repulsive force. The preset relationship may be that the rotation speed of the door body 110 is directly proportional to the repulsive force. For example, the higher the rotation speed of the door body 110, the greater the repulsive force; the lower the rotation speed of the door body 110, the smaller the repulsive force. The preset relationship may also be a desired rotation speed of the door 110 preset in the control terminal 180, and based on the desired rotation speed of the door 110, the relationship between the actual rotation speed, the desired rotation speed of the door 110 and the repulsive force may be determined, and the magnitude of the repulsive force may be controlled based on the relationship.

It should be noted that, in order to ensure the normal operation of the circuit, the first circuit 150 may further include a resistance element connected in series to the first coil 153, which will not be described in detail herein.

As shown in FIG. 1 and FIG. 2, the magnetic device 160 may be installed in one of the door body 110 and the door frame 120 where the first circuit 150 is not installed. For example, the first circuit 150 may be installed on the door body 110 while the magnetic device 160 may be installed on the door frame 120, or the first circuit 150 is installed on the door frame 120 while the magnetic device 160 is installed on the door body 110. The magnetic device 160 may generate a second magnetic field, which may have a repulsive force with the first magnetic field. When the door body 110 and the door frame 120 are closed, the first coil 153 is aligned with the magnetic device 160. When the rotating speed of the door body 110 is too high, and a collision may occur, the repulsive force between the second magnetic field and the first magnetic field may exert a force opposite to the moving direction on the door body 110, thereby reducing the rotating speed of the door body 110 and preventing the collision.

As shown in FIG. 2, the magnetic device 160 may include a magnet **160*a*. An end of the magnet 160*a* close to the first coil 153** may generate the repulsive force with the first magnetic field.

Figure 3:
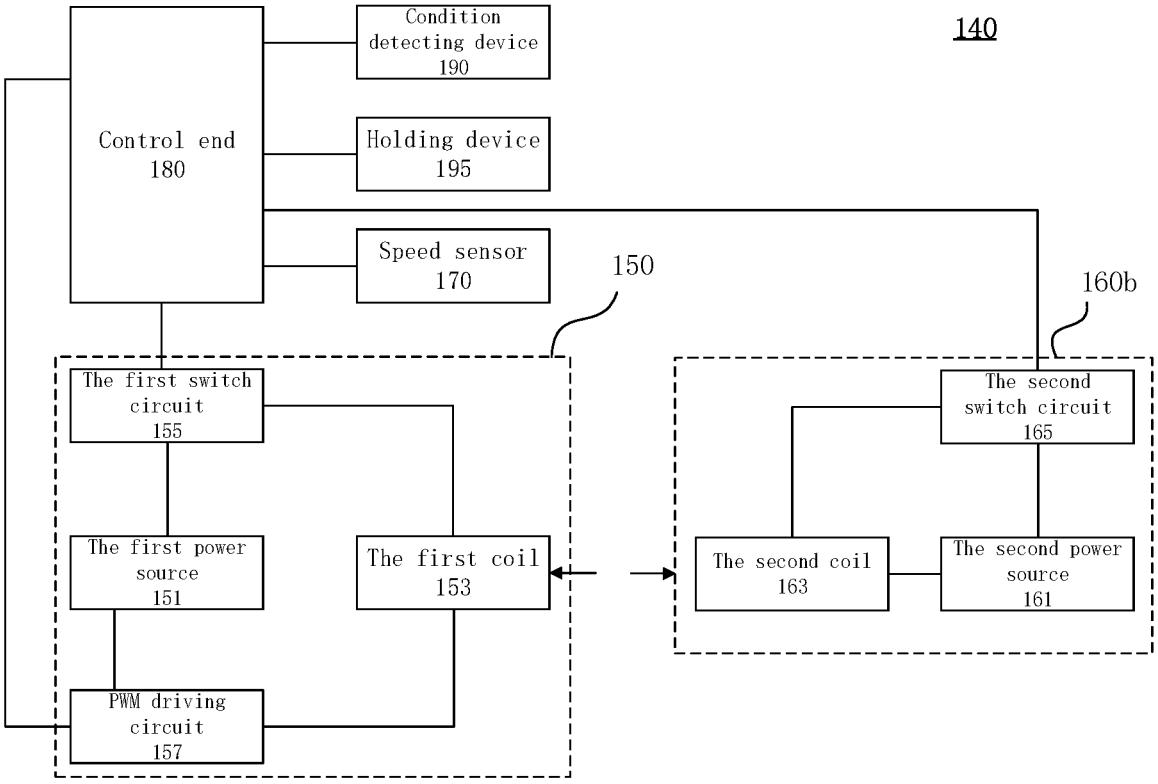
FIG. 3 is a hardware schematic diagram of an anti-collision system provided by some exemplary embodiments of this disclosure.

The second magnetic field of the magnetic device 160 may also be realized by a second circuit 160*b*. FIG. 3 is a hardware schematic diagram of another anti-collision system 140 provided by some exemplary embodiments of this disclosure. The first circuit 150, the speed sensor 170 and the control terminal 180 in FIG. 3 may be the same as those shown in FIG. 2, and will not be described herein again. The magnetic device 160 may include a second circuit 160*b*, as shown in FIG. 3. The second circuit 160*b* may include a second power source 161 and a second coil 163. In some exemplary embodiments, the second circuit 160*b* may further include a second switch circuit 165.

The second power source 161 may be a municipal AC power source (commercial power for short). The specifications of the municipal AC power supply in different regions may be different, which is not specifically limited herein. For example, the municipal AC power supply may be 220V AC in China or 110V AC in the United States or other regions. The municipal AC power supply may be an ordinary municipal AC outlet. The second power source 161 may also be a battery. The battery may be a secondary battery, such as a lithium battery, a nickel-hydrogen battery, a lead-acid battery, etc., or a primary battery, etc. The capacity of the battery may be 20000 mAH, larger, or smaller, such as 30000 mAH or 10000 mAH, or even 4000 mAH, and so on. The second power source 161 and the first power source 151 may be the same power source, or different power sources.

The second coil 163 is an inductance coil connected to the second power source 161. When the second coil 163 is connected to the second power source 161, the second coil 163 may generate the second magnetic field under the current, and the first magnetic field and the second magnetic field may generate a repulsive force.

In some exemplary embodiments, the second circuit 160*b* may further include a second switch circuit 165. The second switch circuit 165 may connect the second coil 163 and the second power source 161. The second switch circuit 165 may be in communication with the control terminal 180, and controls the ON and OFF of the second switch circuit 165 according to the condition of the first switch circuit 155. When the rotation speed of the door 110 is greater than the first threshold, the control terminal 180 may control the first switch circuit 155 to switch on, and simultaneously controls the second switch circuit 165 to switch to ON. The first coil 153 may generate the first magnetic field, the second coil 163 may generate the second magnetic field, and the repulsive force may be generated between the first magnetic field and the second magnetic field, which reduces the rotation speed of the door 110, thereby preventing collision. When the rotation speed of the door 110 is lower than the second threshold, the control terminal 180 may control the first switch circuit 155 to switch off, and simultaneously controls the second switch circuit 165 to switch to OFF, thus the repulsive force disappears, which allows the door 110 to be closed smoothly.

The second switch circuit 165 may include at least one of a programmable switch circuit, a triode switch circuit, or a diode switch circuit. It should be noted that the second switch circuit 165 may also be any other switch circuit, and any switch circuit that may turn on or turn off the second switch circuit 165 through the control terminal 180 is within the scope of this disclosure.

It should be noted that, in order to ensure the normal operation of the circuit, the second circuit 160*b* may also include a resistance element connected in series with the second coil 163, which will not be described in detail herein.

Thus, the second switch circuit 165 may control the generation and elimination of the second magnetic field, and the control terminal 180 may control the repulsive force by simultaneously controlling the first switch circuit 155 and the second switch circuit 165. When the rotation speed of the door body 110 is relatively low and thus the repulsive force is unnecessary, the control terminal 180 may reduce the first magnetic field and the second magnetic field at the same time, so as to avoid the influence of the first magnetic field and the second magnetic field on other objects, for example, to avoid a metal object from being attracted to the second coil 163 when it moves close to the second magnetic field.

As shown in FIG. 1, FIG. 2 and FIG. 3, in some exemplary embodiments, the anti-collision system 140 may further include a state detecting device 190. The state detecting device 190 may be installed on the door body 110 or the door frame 120, and may be in communication with the control terminal 180. The state detecting device 190 may be configured to detect the state of the door body 110, which includes an open state and a closed state. The state detecting device 190 may be either a Hall sensor or a distance sensor. It may detect the state of the door body 110 by measuring the distance between the door body 110 and the door frame 120.

As shown in FIG. 1, FIG. 2 and FIG. 3, in some exemplary embodiments, the anti-collision system 140 may further include a holding device 195. The holding device 195 may be installed on the door body 110 or the door frame 120, and is in communication with the control terminal 180. When the state detecting device 190 detects that the door body 110 is in an open state and the holding device 195 is triggered, the control terminal 180 may control the first switch circuit 155 to switch on and control the duty cycle of the PWM signal to keep the door body 110 in a stationary state, that is, by controlling the duty cycle of the PWM signal, the magnitude of the repulsive force may be controlled, such that the rotation speed of the door body 110 detected by the speed sensor 170 is always 0 or has small fluctuations, thus making the door body 110 keep open for convenience. When a holding instruction of the holding device 195 is terminated, the control terminal 180 may control the first switch circuit 155 to switch off, such that the repulsive force disappears, and the door body 110 is closed smoothly.

In some exemplary embodiments, the anti-collision door 100 may further include certain intelligent devices. The intelligent devices may include surveillance devices, intelligent locks, intelligent doorbells, alarm devices, infrared sensing devices, etc., which are not limited herein.

Figure 4:
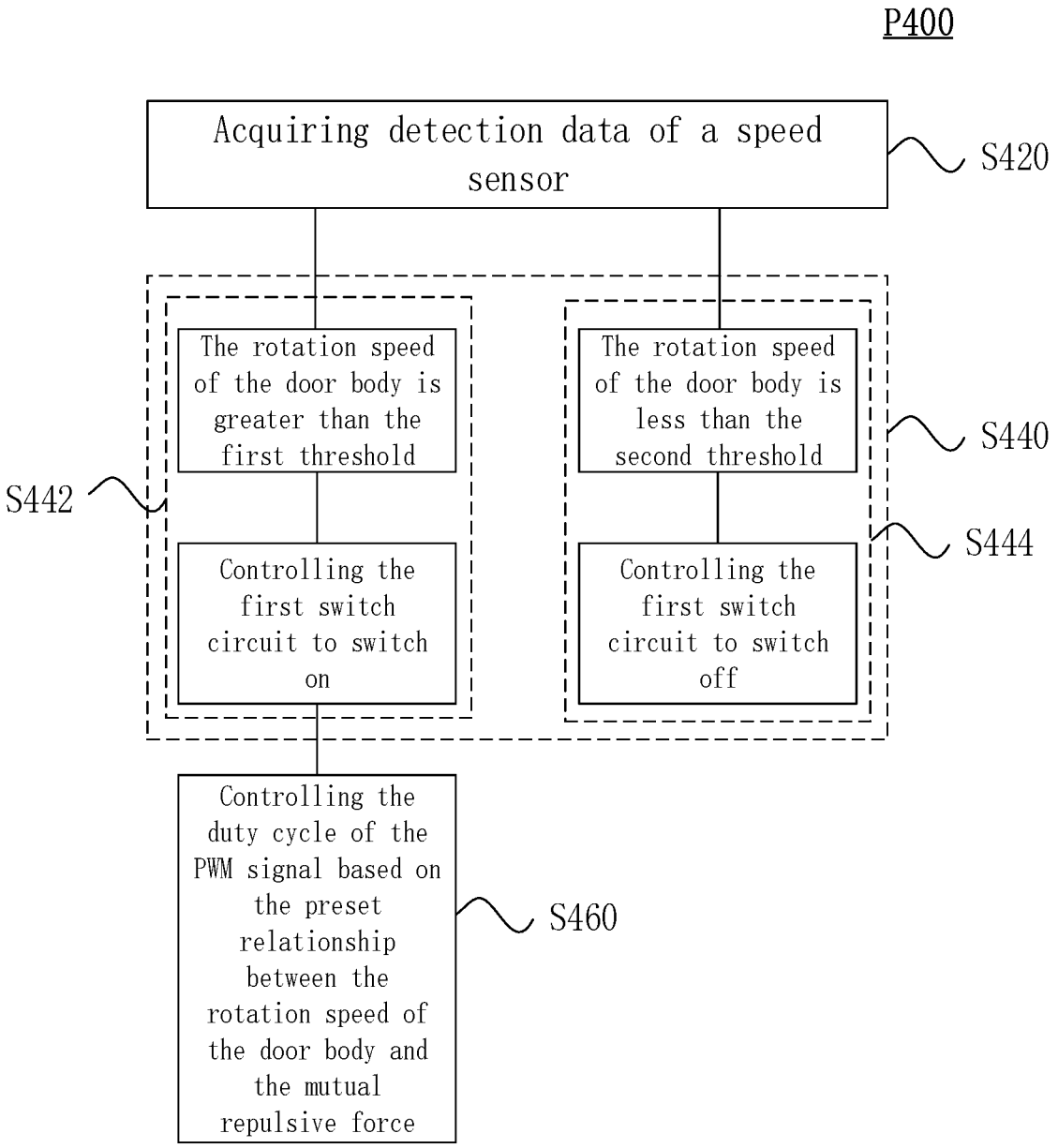
FIG. 4 is a flow chart of an anti-collision method provided by some exemplary embodiments of this disclosure.

FIG. 4 is a flowchart of an anti-collision method P400 provided by some exemplary embodiments of this disclosure. The method P400 may be applied to the anti-collision door 100 and the anti-collision system 140 described herein, or any other device or system that is suitable. The method P400 may include executing the following steps, through the control terminal 180:

S420: Obtain detection data of the speed sensor 170.

S440: Control the first switch circuit 155 to switch on or switch off based on the rotation speed of the door body 110 detected by the speed sensor 170. Step S440 may include the following steps.

S442: When the speed sensor 170 detects that the rotation speed of the door body 110 is greater than the first threshold, control the first switch circuit 155 to switch on. When the magnetic device 160 is the second circuit 160*b*, the control terminal 180 may control the second switch circuit 165 to switch on while controlling the first switch circuit 155 to switch on.

S444: When the speed sensor 170 detects that the rotation speed of the door body 110 is less than the second threshold, control the first switch circuit 155 to switch off. When the magnetic device 160 is the second circuit 160*b*, the control terminal 180 may control the first switch circuit 155 to switch off while controlling the second switch circuit 165 to switch off.

In some exemplary embodiments, the method P400 may further include executing the following steps through the control terminal 180.

S460: Control the duty cycle of the PWM signal based on the preset relationship between the rotation speed of the door 110 and the repulsive force, so as to control the magnitude of the repulsive force.

In summary, in some exemplary embodiments described above, when the rotation speed of the door 110 is greater than the first threshold, the rotation speed of the door 110 is reduced by the repulsive force between the magnetic device 160 and the door 110, until the rotation speed of the door 110 is reduced to less than the second threshold, the repulsive force disappears, and the door 110 continues to rotate, for example, by inertia until the door 110 is in a closed state. However, considering that the door body may not be closed effectively by inertia alone, in some exemplary embodiments of the present disclosure, the door body may be closed by generating an attractive force between the door body and the magnetic device. Some exemplary embodiments of the present disclosure will be described below.

Figure 5:
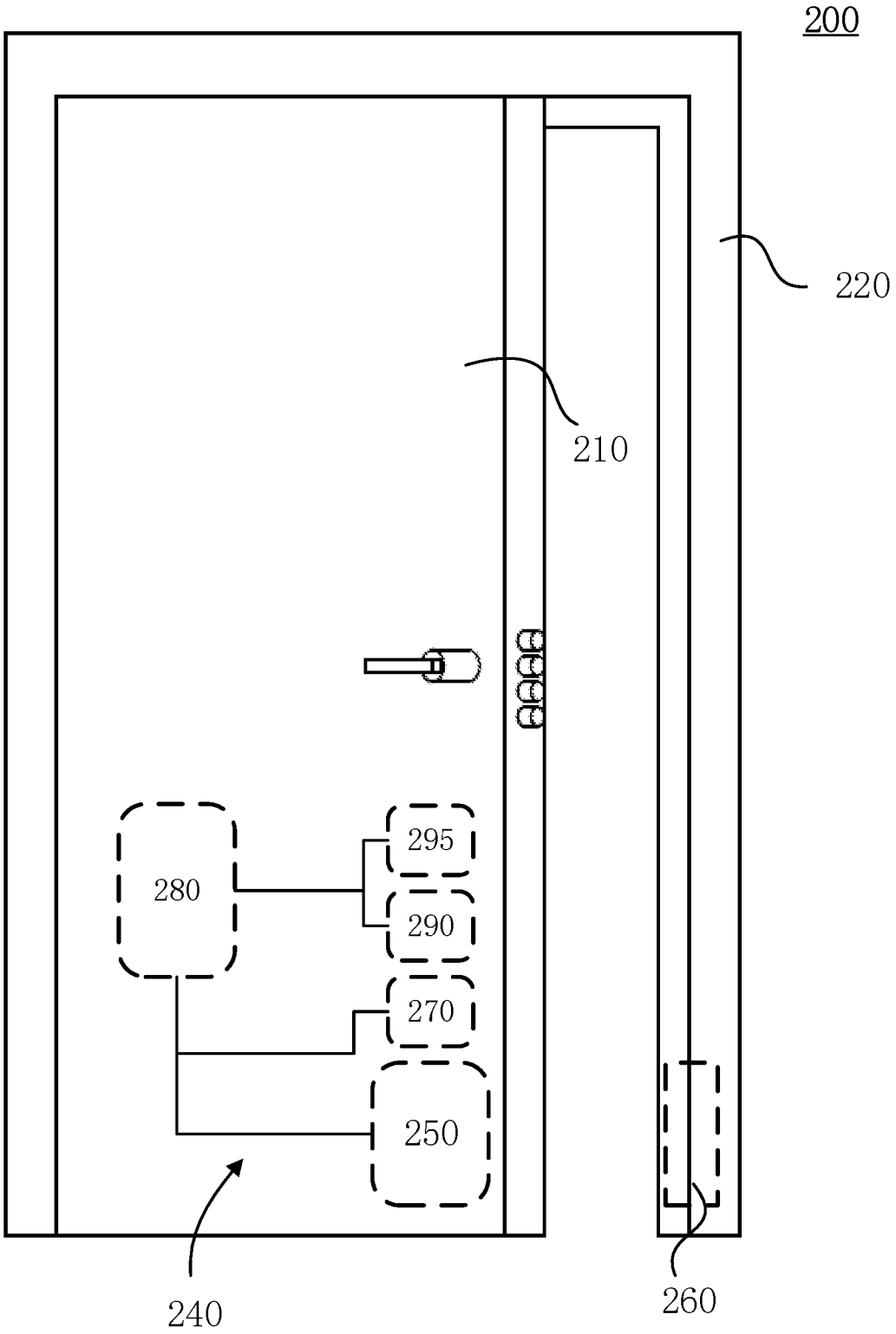
FIG. 5 is a structural schematic diagram of an anti-collision door provided by some exemplary embodiments of this disclosure.

FIG. 5 is a schematic structural diagram of an anti-collision door 200 provided by some exemplary embodiments of this disclosure. The anti-collision door 200 may be a security door of a building, an apartment door inside a building, a door of a room, a door of a secret cabinet, or even a door installed on a window. As shown in FIG. 5, the anti-collision door 200 provided in this disclosure may include a door body 210, a door frame 220 and an anti-collision system 240.

The door body 210 may be installed on the door frame 220 via a hinge, and is rotatably connected to the door frame 220 via the hinge, thereby opening or closing the door body 210.

Figure 6:
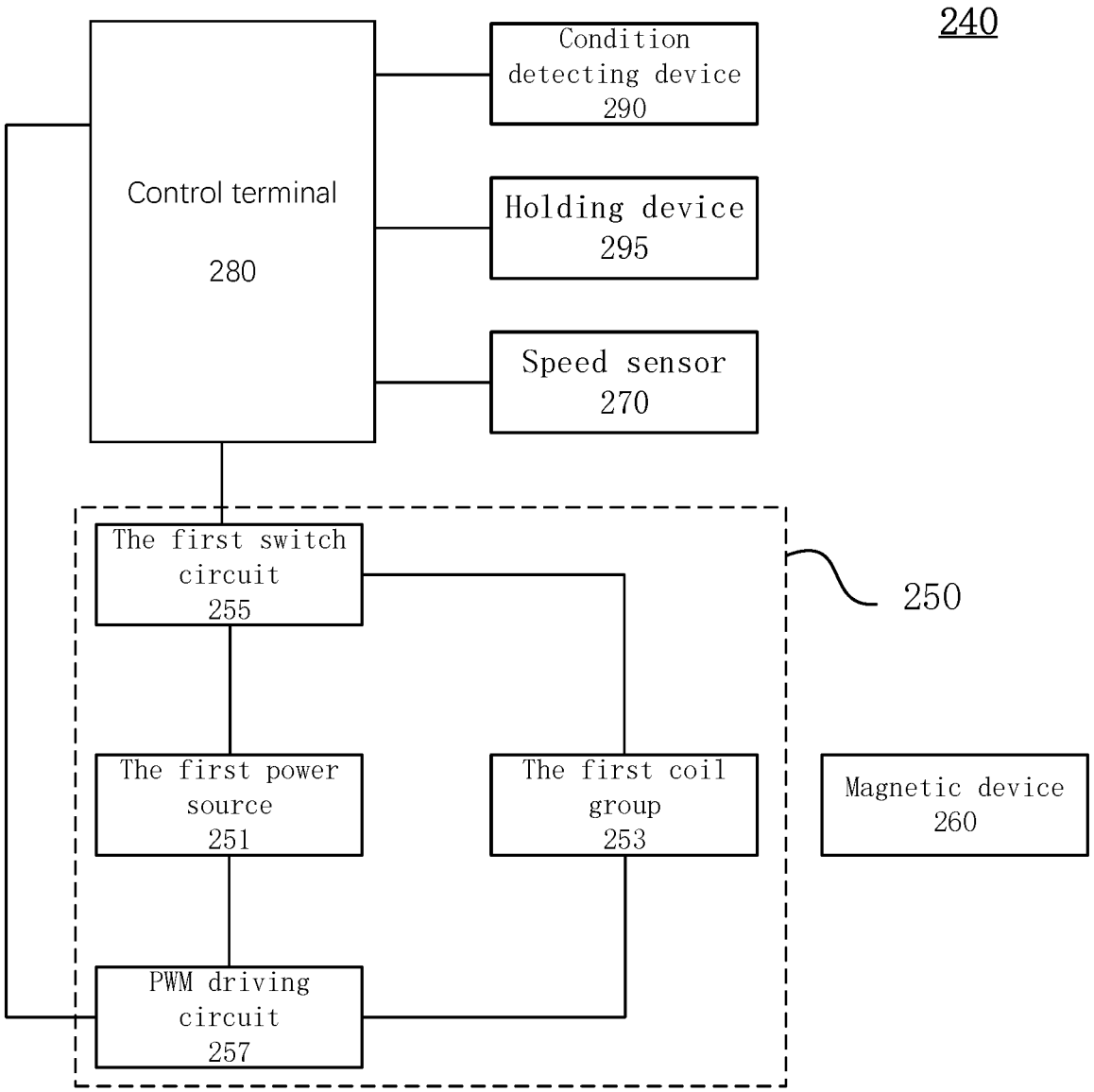
FIG. 6 is a hardware schematic diagram of an anti-collision system provided by some exemplary embodiments of this disclosure.

FIG. 6 is a hardware schematic diagram of an anti-collision system 240 provided by some exemplary embodiments of this disclosure. As shown in FIG. 5 and FIG. 6, the anti-collision system 240 may include a first circuit 250, a magnetic device 260, a speed sensor 270 and a control terminal 180. In some exemplary embodiments, the anti-collision system 240 may further include a state detecting device 290 and a holding device 295. An interaction force may be generated between the first circuit 250 and the magnetic device 260, and the interaction force may be an attractive force or a repulsive force. By changing the direction of the current in the first circuit 250, the direction of the force between the first circuit 250 and the magnetic device 260 may be changed. The first circuit 250 and the magnetic device 260 of the anti-collision system 240 may be on the door body 210 and the door frame 220, respectively. When the rotation speed of the door body 210 is too high, the repulsive force between the first circuit 250 and the magnetic device 260 may reduce the relative speed between the door body 210 and the door frame 220, thereby preventing a collision between the door body 210 and the door frame 220. When the rotation speed of the door body 210 is too low, the door body 210 may be smoothly closed by the attractive force between the first circuit 250 and the magnetic device 260. The first circuit 250 and the magnetic device 260 may be installed at the hinged ends of the door body 210 and the door frame 220, the rotation end of the door body 210 and a corresponding location on the door frame 220, the upper ends of the door body 210 and the door frame 220, or the like. As shown in FIG. 5, the first circuit 250 may be installed at the rotation end of the door body 210, and the magnetic device 260 may be installed on the door frame 220 at a position corresponding to the first circuit 250. FIG. 5 is an exemplary illustration, the first circuit 250 may be installed at any position of the door body 210, and the magnetic device 260 may also be installed at any position of the door frame 220. It should be noted that the first circuit 250 may be installed on the door frame 220, and the magnetic device 260 may be installed on the door body 210, which is also within the scope of protection of this description.

As shown in FIG. 5 and FIG. 6, a speed sensor 270 may be installed on the door body 210 and configured to detect the rotation speed of the door body 210. The speed sensor 270 may include at least one of an acceleration sensor, an angular acceleration sensor, a speed sensor, or an angular speed sensor.

The control terminal 280 may be in communication with the first circuit 250 and the speed sensor 270. In some exemplary embodiments, the control terminal 280 may also be in communication with the magnetic device 260, the state detecting device 290 and the holding device 295. The communication herein refers to any form of communication that may directly or indirectly transmit/receive information, thereby establishing signal transmission. For example, the first circuit 250 and the speed sensor 270 may be directly connected with the control terminal 280 via wires to transmit control signals. The control terminal 280 may control the direction of the interaction force between the first circuit 250 and the magnetic device 260 based on the rotation speed of the door body 210 detected by the speed sensor 270. When the speed sensor 270 detects that the rotation speed of the door 210 is greater than the first threshold, the control terminal 280 may control the first circuit 250 to generate the repulsive force between the first circuit 250 and the magnetic device 260, therefore the rotation speed of the door 210 may be reduced under the repulsive force. When the speed sensor 270 detects that the rotation speed of the door 210 is less than the second threshold, the control terminal 280 may control the first circuit 150 to generate the attractive force between the first circuit 150 and the magnetic device 260, such that the door 210 may be closed smoothly, where the first threshold is greater than the second threshold.

It is clearly that the control terminal 280 controls the direction of the interaction force between the first circuit 250 and the magnetic device 260 according to the rotation speed of the door body 210 through the detection data of the speed sensor 270, which may reduce the rotation speed of the door body 210 and prevent a collision when the door body 210 moves at a relatively high speed. Under the condition that the rotation speed of the door body 210 is relatively low, it may help the door body 210 to be closed smoothly, and avoid the situation that the door is difficult to close.

As shown in FIG. 5 and FIG. 6, in some exemplary embodiments, the anti-collision system 240 may further include a state detecting device 290. The state detecting device 290 may be installed on the door body 210 or the door frame 220, and is in communication with the control terminal 280. The state detecting device 290 may be configured to detect the state of the door body 210, which includes an open state and a closed state. The state detecting device 290 may be either a Hall sensor or a distance sensor to detect the state of the door body 210 by measuring the distance between the door body 210 and the door frame 220.

As shown in FIG. 5 and FIG. 6, the first circuit 250 may be installed on the door body 210 or the door frame 220. The first circuit 250 may include a first power source 251, a first coil group 253, and a first switch circuit 255.

The first power source 251 may be a municipal AC power source (commercial power for short). The specifications of the municipal AC power supply in different regions may be different, which is not specifically limited herein. For example, the municipal AC power supply may be 220V AC in China or 110V AC in the United States or other regions. The municipal AC power supply may be an ordinary municipal AC outlet. The first power source 151 may also be a battery. The battery may be a secondary battery, such as a lithium battery, a nickel-hydrogen battery, a lead-acid battery, etc., or a primary battery, etc. The capacity of the battery may be 20000 mAH, larger, or smaller, such as 30000 mAH or 10000 mAH, or even 4000 mAH, and so on.

The first coil group 253 may at least one inductance coil connected to the first power source 251. When the first coil group 253 is connected to the first power source 251, the first coil group 253 may generate a first magnetic field or a third magnetic field under the current. The first magnetic field generates a repulsive force with the magnetic device 260, and the third magnetic field generates an attractive force with the magnetic device 260.

The first switch circuit 255 may connect the first coil group 253 and the first power source 251. The control terminal 280 may be in communication with the first switch circuit 255, and controls the switch-on mode of the first switch circuit 255 based on the rotation speed of the door body 210 detected by the speed sensor 270. In different switch-on modes of the first switch circuit 255, the direction of the current passing through the first coil group 253 may be different, and the first coil group 253 generates the first magnetic field or the third magnetic field based on the direction of the current.

The switch-on mode of the first switch circuit 255 may include a first mode and a second mode. In the first mode, the first coil group 253 may generate the first magnetic field, and the magnetic device 260 and the first magnetic field have a repulsive force therebetween. In the second mode, the first coil group 253 generates the third magnetic field, and the magnetic device 260 and the third magnetic field have an attractive force therebetween. When the speed sensor 270 detects that the rotation speed of the door body 210 is greater than the first threshold, that is, the rotation speed of the door body 210 is too high, and the door body 210 may collide with the door frame 220, the control terminal 280 may control the first switch circuit 255 to switch on in the first mode, the first coil group 253 is connected to the first power source 251, and a forward current passes through the first coil group 253. The first coil group 253 generates the first magnetic field under this forward current, and a repulsive force is generated between the first magnetic field and the magnetic device 260, which may reduce the rotation speed of the door body 210, thereby preventing the door body 210 from colliding with the door frame 220. When the state detecting device 290 detects that the door body 210 is in an open state and the speed sensor 270 detects that the rotation speed of the door body 210 is less than the second threshold, the control terminal 280 may control the first switch circuit 255 to switch on in the second mode, the first coil group 253 is connected to the first power source 251, and a reverse current passes through the first coil group 253, which may generate the third magnetic field under the reverse current, the attractive force may be generated between the third magnetic field and the magnetic device 260, therefore the door body 210 may be closed smoothly. When the state detecting device 290 detects that the door 210 is in a closed state, the control terminal 280 may control the first switch circuit 255 to switch off, the first coil group 253 and the first power source 251 is disconnected, such that no current passes through the first coil group 253, and the first coil group 253 may not generate the first magnetic field or the third magnetic field, thus saving energy and avoiding the influence of the first magnetic field or the third magnetic field on other objects.

In summary, by controlling the first switch circuit 255 by the control terminal 280, the direction of the first magnetic field may be controlled, such that the door body 210 may generate a repulsive force, when the door moves at a high speed, to reduce the speed of the door body 210, so as to prevent a collision, and may generate an attractive force when the door body 210 moves at a low speed, such that the door body may be closed smoothly, thereby effectively preventing the collision without affecting smoothly closing the door.

Figure 7:
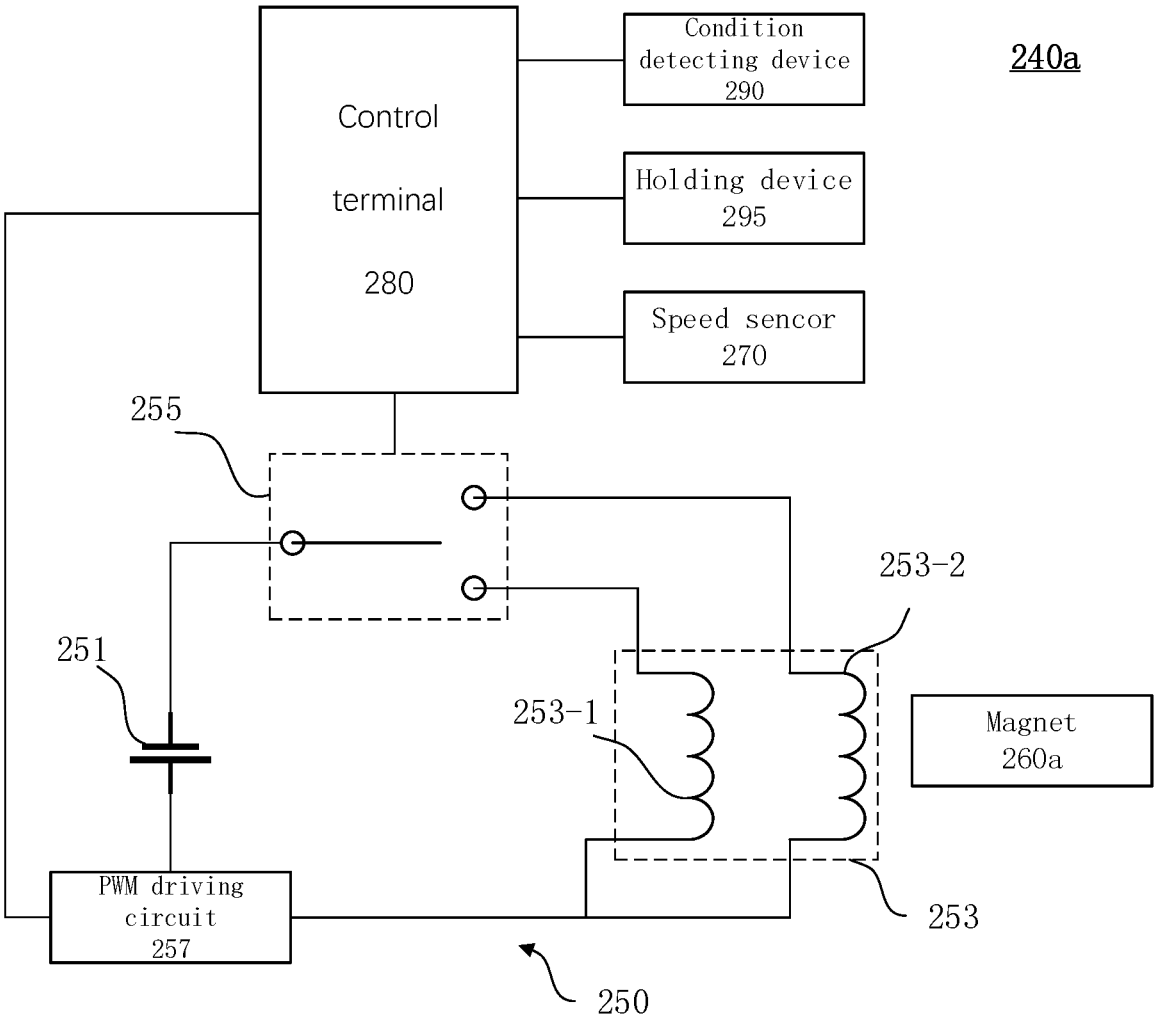
FIG. 7 is a schematic circuit diagram of an anti-collision system provided by some exemplary embodiments of this disclosure.

The anti-collision system 240 may realize that the first coil group 253 generates the first magnetic field or the third magnetic field in different ways. FIG. 7 is a schematic circuit diagram of an anti-collision system 240*a* provided in some exemplary embodiments of this disclosure. As shown in FIG. 7, the first coil group 253 may include a first coil 253-1 and a third coil 253-2 connected in parallel. The winding direction of the first coil 253-1 is opposite to that of the third coil 253-2. The first switch circuit 255 may be a double-on switch. The double-on switch may be connected to the first coil 253-1 and the third coil 253-2, respectively. When the first switch circuit 255 is switched on in the first mode, the first coil 253-1 may be connected to the first power source 251, and the third coil 253-2 may be disconnected from the first power source 251. The first coil 253-1 generates the first magnetic field under the current. When the first switch circuit 255 is switched on in the second mode, the third coil 253-2 may be connected to the first power source 251, and the first coil 253-1 may be disconnected from the first power supply 251. The third coil 253-2 generates the third magnetic field under the current. When the first switch circuit 255 is connected to neither the first coil 253-1 nor the third coil 253-2, no current passes through the first coil 253-1 and the third coil 253-2, and the first magnetic field and the third magnetic field will not be generated.

Figure 8:
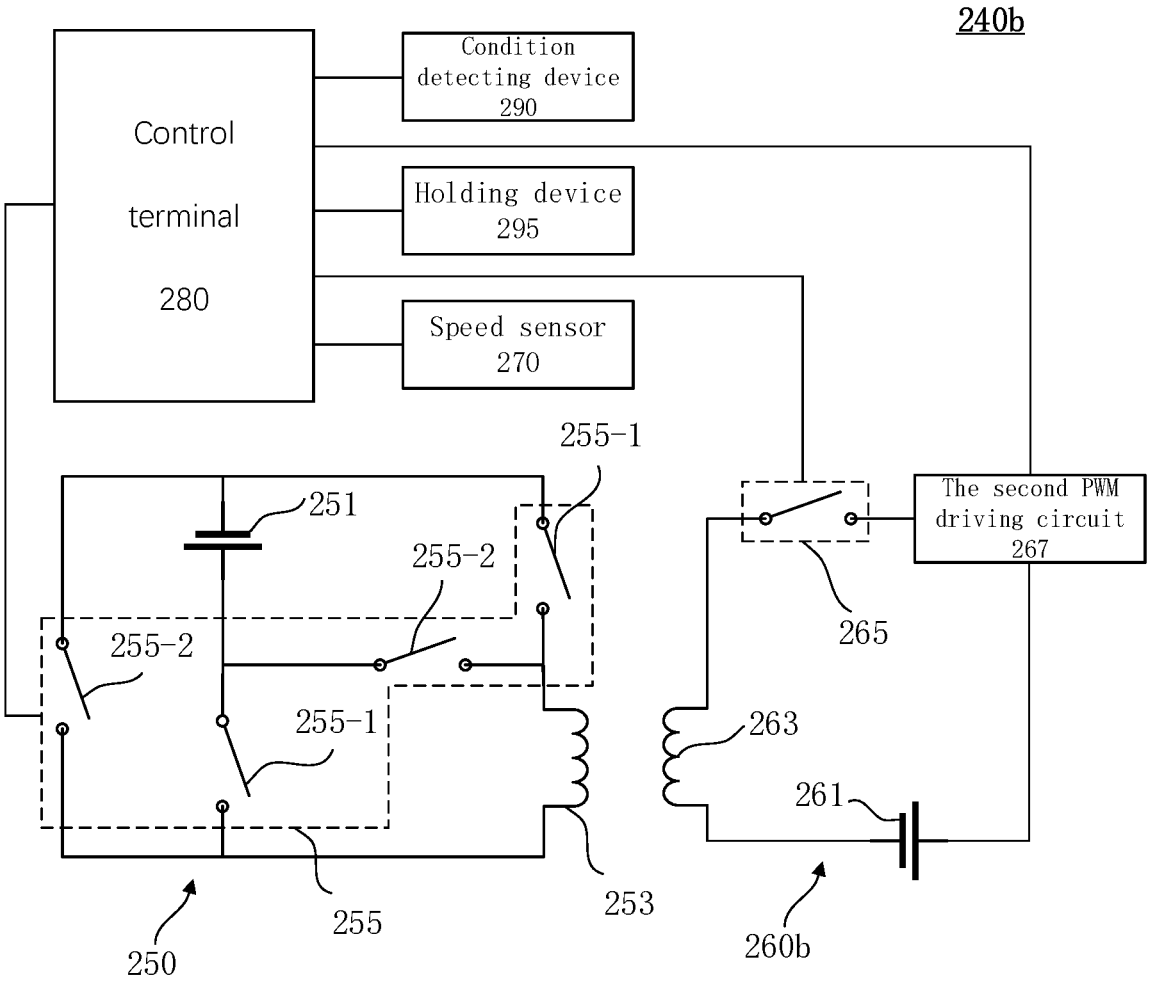
FIG. 8 is a schematic circuit diagram of an anti-collision system provided by some exemplary embodiments of this disclosure.

FIG. 8 is a schematic circuit diagram of an anti-collision system 240*b* provided by some exemplary embodiments of this disclosure. As shown in FIG. 8, the first switch circuit 255 may include a first switch group 255-1 and a second switch group 255-2. When the first switch circuit 255 is switched on in the first mode, the first switch group 255-1 is switched on and the second switch group 255-2 is switched off, a current passes through the first coil group 253 in a forward direction, and the first coil group 253 generates the first magnetic field under the current. When the first switch circuit 255 is switched on in the second mode, the second switch group 255-2 is switched on and the first switch group 255-1 is switched off, and a current passes through the first coil group 253 in a reverse direction, and the third magnetic field is generated under the reverse current. When both the first switch group 255-1 and the second switch group 255-2 are switched off, the first coil group 253 is disconnected from the first power source 251, and no current passes through the first coil group 253, therefore the first magnetic field and the third magnetic field may be not generated.

The first switch circuit 255 may include at least one of a programmable switch circuit, a triode switch circuit, or a diode switch circuit. That is, each switch group in the first switch circuit 255 may include at least one of a programmable switch circuit, a triode switch circuit, or a diode switch circuit. For example, the first switch circuit 255 may be the programmable relay switch, which is connected to the control terminal 280, and the control terminal 280 may control the switch-on mode of the programmable relay switch by controlling the voltage of the programmable relay switch. For example, the first switch circuit 255 may be the triode switch circuit, and the control terminal 280 may control the switch-on mode of the triode switch circuit by controlling the voltage input to the triode switch circuit. For example, the first switch circuit 255 may be the diode switch circuit, and the control terminal 280 may control the diode switch circuit in the same way as the triode switch circuit, which will not be described herein again. It should be noted that the first switch circuit 255 may also be any other switch circuit that may realize the switch-on mode of the first switch circuit 255 through the control terminal 280, which is within the scope of protection of this disclosure.

As shown in FIG. 5 to FIG. 8, in some exemplary embodiments, the first circuit 255 may further include a PWM driving circuit 257 connected to the first power source 251 and the first coil group 253. The PWM driving circuit 257 may be in communication with the control terminal 280. The control terminal 280 may control the voltage of the first coil group 253 by controlling the duty cycle of the PWM signal of the PWM driving circuit 257, thereby controlling the magnitude of the applied force. Specifically, the control terminal 280 may control the duty cycle of the PWM signal based on a preset relationship between the rotation speed of the door body 210 and an interaction force. The preset relationship may be that the rotation speed of the door body 210 is directly proportional to the interaction force. For example, the higher the rotation speed of the door body 210, the greater the repulsive force; the lower the rotation speed of the door body 210, the smaller the repulsive force. The preset relationship may also be preset in the control terminal 280 as a desired rotation speed of the door 210, and based on the desired rotation speed of the door 210, the relationship between the actual rotation speed, the desired rotation speed of the door 210 and the repulsive force may be determined. Thus, the magnitude of the repulsive force is controlled based on the relationship.

It should be noted that, in order to ensure the normal operation of the circuit, the first circuit 250 may also include a resistance element connected in series to the first coil group 253, which will not be described in detail herein.

As shown in FIG. 5 and FIG. 6, the magnetic device 260 may be installed in one of the door body 210 and the door frame 220 where the first circuit 250 is not installed. For example, the first circuit 250 may be installed on the door 210 while the magnetic device 260 may be installed on the door frame 220, or the first circuit 250 is installed on the door frame 220 and the magnetic device 260 may be installed on the door 210. The magnetic device 260 may generate a second magnetic field, which generates a repulsive force with the first magnetic field and generates an attractive force with the third magnetic field. When the door body 210 is closed with the door frame 220, the first coil group 253 may be aligned with the magnetic device 260. When the rotation speed of the door body 210 is too high and a collision may occur, a repulsive force may be generated between the second magnetic field and the first magnetic field, which may exert a force opposite to the moving direction on the door body 210, thereby reducing the rotation speed of the door body 210 and achieving the purpose of preventing the collision. When the rotation speed of the door body 210 is too low, an attractive force is generated between the second magnetic field and the third magnetic field, and a force in the same direction as the moving direction may be applied to the door body 210, such that the door body 210 may be closed smoothly.

As shown in FIG. 7, the magnetic device 260 may include a magnet 260*a*. An end of the magnet 260*a* close to the first coil group 253 and the first magnetic field or the third magnetic field may generate a repulsive force or an attractive force.

As shown in FIG. 8, the second magnetic field of the magnetic device 260 may be generated by a second circuit 260*b*. The magnetic device 260 may include a second circuit 260*b*, as shown in FIG. 8. The second circuit 260*b* may include a second power source 261 and a second coil group 263. In some exemplary embodiments, the second circuit 260*b* may further include a second switch circuit 265.

The second power source 261 may be a municipal AC power source (commercial power for short). The specifications of the municipal AC power supply in different regions may be different, which is not specifically limited herein. For example, the municipal AC power supply may be 220V AC in China or 110V AC in the United States or other regions. The municipal AC power supply may be an ordinary municipal AC outlet. The second power source 261 may also be a battery. The battery may be a secondary battery, such as a lithium battery, a nickel-hydrogen battery, a lead-acid battery, etc., or a primary battery, etc. The capacity of the battery may be 20000 mAH, larger, or smaller, such as 30000 mAH or 10000 mAH, or even 4000 mAH, and so on. The second power source 261 and the first power source 251 may be the same power source or different power sources.

The second coil group 263 may be at least an inductance coil and is connected to the second power source 261. When the second coil group 263 is connected to the second power source 261, the second coil group 263 may generate the second magnetic field under a current, and an interaction force is generated between the first magnetic field and the second magnetic field.

In some exemplary embodiments, the second circuit 260*b* may further include a second switch circuit 265. The second switch circuit 265 may connect the second coil group 263 and the second power source 261. The second switch circuit 265 may be in communication with the control terminal 280, and controls the switch on and switch off of the second switch circuit 265 based on the state of the first switch circuit 255. When the rotation speed of the door 210 is greater than the first threshold, the control terminal 280 controls the first switch circuit 255 to switch on in the first mode and the second switch circuit 265 to switch on. The first coil group 253 may generate the first magnetic field and the second coil group 263 generates the second magnetic field, causing a repulsive force between the first magnetic field and the second magnetic field, thus reducing the rotation speed of the door 210 and preventing a collision. When the door body 210 is in an open state and the rotation speed of the door body 210 is lower than the second threshold, the control terminal 280 may control the first switch circuit 255 to switch on in the second mode, and simultaneously controls the second switch circuit 265 to switch on, such that the first coil group 253 may generate the third magnetic field, and the second coil group 263 may generate the second magnetic field, thus an attractive force is generated between the third magnetic field and the second magnetic field. Thus, the door body 210 may be closed smoothly. When the door body 210 is in a closed state, the control terminal 280 controls the first switch circuit 255 to switch off, and simultaneously controls the second switch circuit 265 to switch off, thereby saving energy and avoiding the influence of the first magnetic field or the third magnetic field and the second magnetic field on other objects close thereto.

The second switch circuit 265 may include at least one of a programmable switch circuit, a triode switch circuit, or a diode switch circuit. It should be noted that the second switch circuit 265 may also be any other switch circuit that may switch on or switch off the second switch circuit 265 through the control terminal 280, which is within the scope of this disclosure.

In some exemplary embodiments, the second circuit 260*b* may further include a second PWM driving circuit 267 connected to the second power source 261 and the second coil group 263. The second PWM driving circuit 267 may be in communication with the control terminal 280. The control terminal 280 may control the voltage of the second coil group 263 by controlling the duty cycle of the PWM signal, thereby controlling the magnitude of the applied force. Specifically, the control terminal 280 may control the duty cycle of the PWM signal based on a preset relationship between the rotation speed of the door body 210 and an interaction force. The preset relationship may be that the rotation speed of the door body 210 is directly proportional to the interaction force.

The PWM driving circuit 257 and the second PWM driving circuit 267 control the interaction force in the same way. The anti-collision system 240 may include only one of the PWM driving circuit 257 and the second PWM driving circuit 267. That is, when the first circuit 250 includes the PWM driving circuit 257, the second circuit 260*b* may not include the second PWM driving circuit 267. The first circuit 250 may not include the PWM driving circuit 257 when the second circuit 260*b* includes the second PWM driving circuit 267. The control terminal 280 may control the magnitude of the interaction force by controlling the PWM driving circuit 257 or the second PWM driving circuit 267.

It should be noted that, in order to ensure the normal operation of the circuit, the second circuit 260*b* may also include a resistance element connected in series to the second coil group 263, which will not be described in detail in this disclosure.

Thus, the second switch circuit 265 may control the generation and elimination of the second magnetic field, and the control terminal 280 may control the repulsive force and attractive force by simultaneously controlling the first switch circuit 255 and the second switch circuit 265. When the door body 210 is closed, the attractive force is not needed, and the control terminal 280 may turn off both the third magnetic field and the second magnetic field, so as to avoid the influence of the second magnetic field on other objects, for example, to prevent a metal object from being attracted to the second coil group 263 when it is close to the second magnetic field.

As shown in FIG. 5 to FIG. 8, in some exemplary embodiments, the anti-collision system 240 may further include a holding device 295. The holding device 295 may be installed on the door body 210 or the door frame 220, and is in communication with the control terminal 280. When the state detecting device 290 detects that the door body 210 is in an open state and the holding device 295 is triggered, the control terminal 280 may control the first switch circuit 255 to switch on in the first mode and control the duty cycle of the PWM signal to keep the door body 210 in a stationary state, that is, by controlling the duty cycle of the PWM signal, the magnitude of the repulsive force may be controlled to allow the rotation speed of the door body 210 detected by the speed sensor 270 to be always zero or with small fluctuations, therefore, the door body 210 is kept open for convenience. When the holding instruction of the holding device 295 is terminated, the control terminal 280 may control the first switch circuit 255 to switch off, such that the repulsive force disappears, so as to allow the door 210 to be closed smoothly. The duty cycle of the PWM signal may be the duty cycle of the PWM signal in the PWM driving circuit 257 or the duty cycle of the PWM signal in the second PWM driving circuit 267.

In some exemplary embodiments, the anti-collision door 200 may further include certain intelligent devices. The intelligent devices may include surveillance devices, intelligent locks, intelligent doorbells, alarm devices, infrared sensing devices, etc., which are not described in detail herein.

Figure 9:
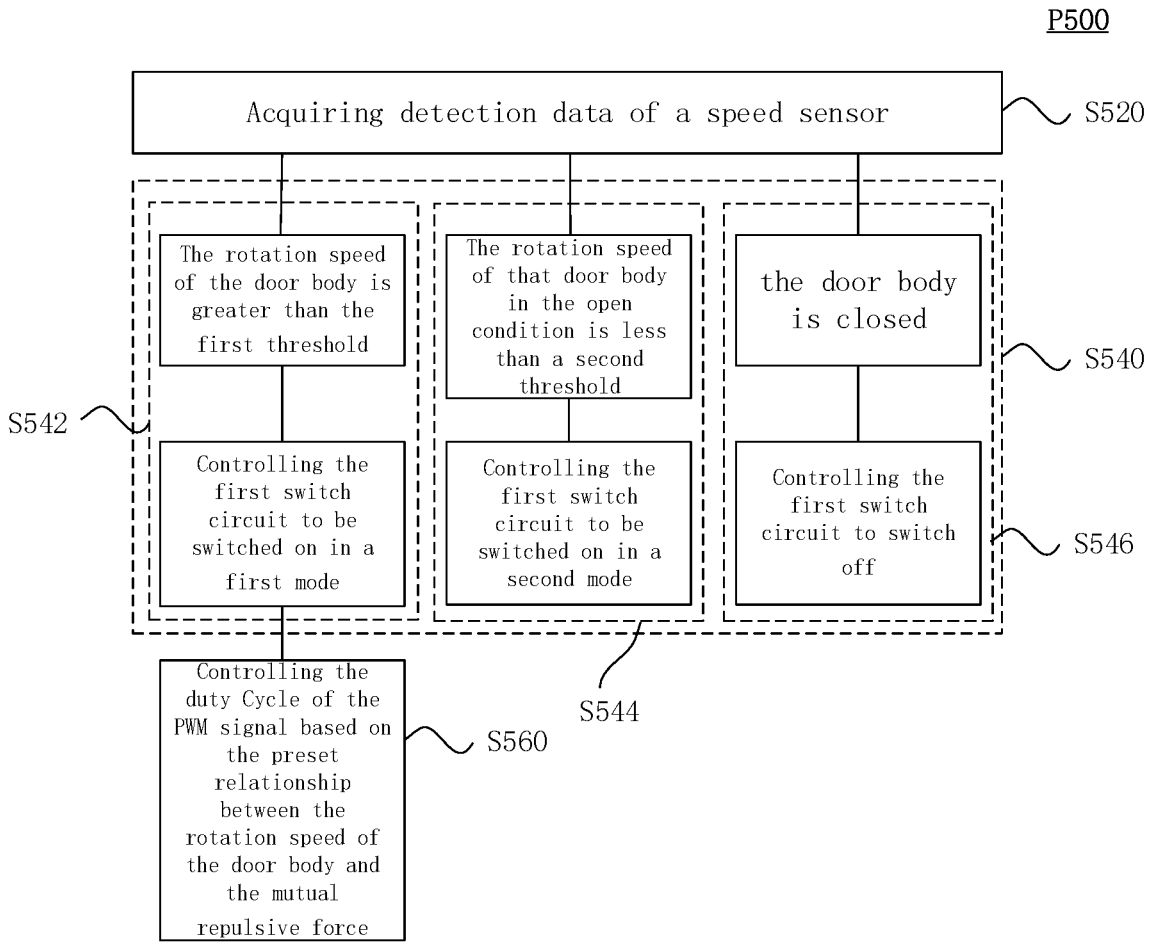
FIG. 9 is a flow chart of an anti-collision method provided by some exemplary embodiments of this disclosure.

FIG. 9 is a flowchart of an anti-collision method P500 provided by some exemplary embodiments of this disclosure. The method P500 may be applied to the anti-collision door 200 and the anti-collision system 240, or any other suitable device. The method P500 includes executing the following steps through the control terminal 280.

S520: Obtain detection data of the speed sensor 270.

S540: Control the switch-on mode of the first switch circuit 255 based on the rotation speed of the door body 210 detected by the speed sensor 270. Step S540 may include the following steps.

S542: When the speed sensor 270 detects that the rotation speed of the door 210 is greater than the first threshold, control the first switch circuit 255 to switch on in the first mode. When the magnetic device 260 is the second circuit 260*b*, the control terminal 280 may control the first switch circuit 255 to switch on in the first mode and controls the second switch circuit 265 to switch on.

S544: When the state detecting device 290 detects that the door 210 is in an open state and the speed sensor 270 detects that the rotation speed of the door 210 is less than the second threshold, the first switch circuit 255 is controlled to switch on in the second mode. When the magnetic device 260 is the second circuit 260*b*, the control terminal 280 may control the first switch circuit 255 to switch on in the second mode and controls the second switch circuit 265 to switch on.

S546: When the state detecting device 290 detects that the door body 210 is in a closed state, the first switch circuit 255 is controlled to be switch off. When the magnetic device 260 is the second circuit 260*b*, the control terminal 280 may control the first switch circuit 255 to switch off and the second switch circuit 265 to switch off.

In summary, after reading this detailed disclosure, those skilled in the art may understand that the foregoing detailed disclosure is presented by way of example only and is restrictive. Although not explicitly stated herein, those skilled in the art will understand that this disclosure is intended to cover various changes, improvements and modifications of the embodiments. These changes, improvements and modifications are intended to be proposed by this disclosure and are within the principles and scope of the exemplary embodiments of this disclosure.

In addition, certain terms in this disclosure have been used to describe embodiments of the present disclosure. For example, "one embodiment," "an embodiment," and/or "some embodiments" mean that a particular feature, structure or characteristic described in connection with the embodiment may be included in at least one embodiment of the present disclosure. Therefore, it can be emphasized and understood that two or more references to "embodiment" or "one embodiment" or "alternative embodiment" in various parts of this disclosure do not necessarily refer to the same embodiment. In addition, specific features, structures, or characteristics may be combined as appropriate in one or more embodiments of the present disclosure.

It should be understood that in the foregoing description of some exemplary embodiments of the present disclosure, in order to help understand one feature, and for the purpose of simplifying the present disclosure, the present disclosure combines various features in a single embodiment, drawings, or descriptions thereof. However, this does not mean that the combination of these features is necessary, and it is entirely possible for those skilled in the art to extract some of the features as separate embodiments when reading this disclosure. That is to say, the embodiments in this disclosure may also be understood as the integration of multiple sub-embodiments. However, the content of each sub-embodiment is also true when it is less than all the features of a single previously disclosed exemplary embodiment.

Each patent, patent application, publication of patent application and other materials cited herein, such as articles, books, specifications, publications, documents, articles, etc., may be incorporated herein by reference. All contents used for all purposes, except any history of prosecution documents related to them, may be inconsistent or conflict with this document, or any same history of prosecution documents that may have a restrictive effect on the broadest scope of claims are now or later associated with this document. For example, if there is any inconsistency or conflict between the description, definition and/or use of terms related to this document, the terms in this document shall prevail.

Finally, it should be understood that the exemplary embodiments of the disclosure disclosed herein are illustration of the principles of the embodiments of this disclosure. Other modified embodiments are also within the scope of this disclosure. Therefore, the embodiments disclosed in this disclosure are merely examples and not limitations. Those skilled in the art may implement the disclosures disclosed herein by adopting alternative configurations according to the embodiments in this disclosure. Therefore, the embodiments of this disclosure are not limited to the embodiments accurately described in the disclosure.

What is claimed is:

1. An anti-slamming system, comprising:

a first circuit installed on a door body or a door frame of an anti-slamming door, including:

a first power source, a first coil connected to the first power source to generate a first magnetic field, and a first switch circuit connected to the first coil and the first power source;

a magnetic device arranged on the door body or the door frame, where the first circuit is not installed, to generate a first repulsive force with the first magnetic field when the door body is rotating with respect to a door frame, to reduce a relative speed between the door body and the door frame;

a speed sensor arranged on the door body to detect a rotation speed of the door body; and a control terminal in communication with the speed sensor and the first switch circuit to control the first switch circuit to switch on or switch off, based on the rotation speed of the door body detected by the speed sensor.

2. The anti-slamming system according to claim 1, wherein, the control terminal controls the first switch circuit to switch on when the rotation speed of the door body is greater than a first threshold; and the control terminal controls the first switch circuit to switch off when the rotation speed of the door body is less than a second threshold, wherein the first threshold is greater than the second threshold.

3. The anti-slamming system according to claim 1, wherein, the first circuit further includes a PWM driving circuit connected to the first power source and the first coil;

the PWM driving circuit is in communication connection with the control terminal;

the control terminal controls a voltage of the first coil by controlling a duty cycle of a PWM signal of the PWM driving circuit, thereby controlling the magnitude of the first repulsive force;

the control terminal controls the duty cycle of the PWM signal based on a preset relationship between the rotation speed of the door body and the first repulsive force; and the preset relationship includes that the rotation speed of the door body is directly proportional to the first repulsive force.

4. The anti-slamming system according to claim 3, further comprising:

a holding device in communication with the control terminal, wherein the control terminal controls the first switch circuit to switch on when the holding device is triggered, and controls the duty cycle of the PWM signal to keep the door body in a stationary state.

5. The anti-slamming according to claim 1, wherein the first coil is aligned with the magnetic device when the door body is closed.

6. The anti-slamming system according to claim 1, wherein the magnetic device includes a second circuit; and the second circuit includes:

a second power source, and a second coil connected to the second power source to generate a second magnetic field, wherein the first magnetic field and the second magnetic field generate a second repulsive force.

7. The anti-slamming system according to claim 6, wherein the second circuit further includes:

a second switch circuit connected to the second coil and the second power source, and in communication connection with the control terminal, wherein the control terminal controls the second switch circuit to switch off when the first switch circuit is switched off, and the control terminal controls the second switch circuit to switch on when the first switch circuit is switched on.

8. The anti-slamming system according to claim 1, wherein the first circuit further includes a third coil connected to the first power source to generate a third magnetic field;

a direction of the third magnetic field is opposite to a direction of the first magnetic field;

the first switch circuit is connected to the third coil; and the magnetic device generates an attractive force with the third magnetic field.

9. The anti-slamming system according to claim 8, wherein the first switch circuit includes:

a first mode in which the first coil generates the first magnetic field, and a second mode in which the third coil generates the third magnetic field.

10. The anti-slamming system according to claim 9, wherein the control terminal controls the first switch circuit to switch on in the first mode when the rotation speed of the door body is greater than a first threshold.

11. The anti-slamming system according to claim 10, further comprising a state detecting device installed on the door body to detect a state of the door body, wherein the state detecting device is in communication with the control terminal, the state of the door body includes: an open state or a closed state, the control terminal controls the first switch circuit to switch on in the second mode when the state detecting device detects that the door is in the open state and the speed sensor detects that the rotation speed of the door is less than a second threshold, wherein the first threshold is greater than the second threshold, and the control terminal controls the first switch circuit to switch off when the state detecting device detects that the door body is in the closed state.

12. The anti-slamming system according to claim 9, wherein, when the first switch circuit is switched on in the first mode, the first coil is connected to the first power source, the third coil is disconnected from the first power source, and the first coil generates the first magnetic field; and when the first switch circuit is switched on in the second mode, the third coil is connected to the first power source, the first coil is disconnected from the first power source, and the third coil generates the third magnetic field.

13. The anti-slamming system according to claim 8, wherein when the door body is closed, the third coil is aligned with the magnetic device.

14. An anti-slamming method, comprising:

providing an anti-slamming system, wherein the anti-slamming system includes:

a first circuit installed on a door body or a door frame of an anti-slamming door, including:

a first power source, a first coil connected to the first power source to generate a first magnetic field, and a first switch circuit connected to the first coil and the first power source, a magnetic device arranged on the door body or the door frame, where the first circuit is not installed, to generate a first repulsive force with the first magnetic field when the door body is rotating with respect to a door frame, to reduce a relative speed between the door body and the door frame, a speed sensor arranged on the door body to detect a rotation speed of the door body, and a control terminal in communication with the speed sensor and the first switch circuit;

obtaining, by the control terminal, the rotation speed of the door body detected by the speed sensor; and controlling, by the control terminal, the first switch circuit to switch on or switch off, based on the rotation speed of the door body.

15. The anti-slamming method according to claim 14, wherein the controlling of the first switch circuit to switch on or switch off includes:

controlling the first switch circuit to switch on when the rotation speed of the door body is greater than a first threshold; and controlling the first switch circuit to switch off when rotation speed of the door body is less than a second threshold, wherein the first threshold is greater than the second threshold.

16. The anti-slamming method according to claim 14, further comprising:

providing a PWM driving circuit for the first circuit, wherein the PWM driving circuit is connected to the first power source and the first coil and in communication connection with the control terminal;

controlling, by the control terminal, a voltage of the first coil by controlling a duty cycle of a PWM signal of the PWM driving circuit, so as to control the magnitude of the first repulsive force; and controlling the duty cycle of the PWM signal based on a preset relationship between the rotation speed of the door body and the first repulsive force, wherein the preset relationship includes that the rotation speed of the door body is directly proportional to the first repulsive force.

17. The anti-slamming method according to claim 14, wherein the first circuit further includes a third coil connected to the first power source to generate a third magnetic field;

a direction of the third magnetic field is opposite to a direction of the first magnetic field;

the first switch circuit is connected to the third coil; and the magnetic device generates an attractive force with the third magnetic field.

18. The anti-slamming method according to claim 17, wherein the first switch circuit includes:

a first mode in which the first coil generates the first magnetic field, and a second mode in which the third coil generates the third magnetic field.

19. The anti-slamming method according to claim 18, wherein the controlling of the first switch circuit to switch on or switch off includes:

controlling, by the control terminal, the first switch circuit to switch on in the first mode when the rotation speed of the door body is greater than a first threshold.

20. The anti-slamming method according to claim 19, further comprising:

Providing a state detecting device for the anti-slamming system, wherein the state detecting device is installed on the door body to detect a state of the door body, the state detecting device is in communication with the control terminal, the state of the door body includes: an open state or a closed state, controlling, by the control terminal, to control the first switch circuit to switch on in the second mode when the state detecting device detects that the door is in the open state and the speed sensor detects that the rotation speed of the door is less than a second threshold, wherein the first threshold is greater than the second threshold; and controlling, by the control terminal, the first switch circuit to switch off when the state detecting device detects that the door body is in the closed state.

* * * * *